US010272295B2

(12) United States Patent
Viarani et al.

(10) Patent No.: US 10,272,295 B2
(45) Date of Patent: Apr. 30, 2019

(54) CONTROL SYSTEM OF A CYCLING SIMULATION DEVICE

(71) Applicant: TECHNOGYM S.P.A., Cesena (IT)

(72) Inventors: Luigi Viarani, Cesena (IT); Claudio Cristofori, Cesena (IT); Marco Lorusso, Cesena (IT)

(73) Assignee: TECHNOGYM S.P.A., Cesena (IT)

( * ) Notice: Subject to any disclaimer, the term of this patent is extended or adjusted under 35 U.S.C. 154(b) by 0 days.

(21) Appl. No.: 15/635,763

(22) Filed: Jun. 28, 2017

(65) Prior Publication Data

US 2018/0001142 A1 Jan. 4, 2018

(30) Foreign Application Priority Data

Jul. 1, 2016 (IT) ..... 102016000068770

(51) Int. Cl.
*A63B 21/00* (2006.01)
*A63B 21/22* (2006.01)
(Continued)

(52) U.S. Cl.
CPC ..... *A63B 24/0087* (2013.01); *A63B 21/0051* (2013.01); *A63B 21/0057* (2013.01);
(Continued)

(58) Field of Classification Search
CPC ..... A63B 24/0087; A63B 71/0622; A63B 21/0051; A63B 21/225; A63B 22/0605;
(Continued)

(56) References Cited

U.S. PATENT DOCUMENTS 5,616,104 A * 4/1997 Mulenburg ..... A63B 22/0605 472/21
6,450,922 B1 * 9/2002 Henderson ..... A63B 24/0006 482/8

(Continued)

FOREIGN PATENT DOCUMENTS

EP 2 703 051 A2 3/2014
EP 2 716 330 A1 4/2014
WO WO 2008/002644 A2 1/2008

OTHER PUBLICATIONS

International Search Report and Written Opinion issued in Italian Patent Application No. 201600068770 dated Apr. 12, 2017.

*Primary Examiner* — Andrew S Lo
(74) *Attorney, Agent, or Firm* — Arent Fox LLP

(57) ABSTRACT

Control system of a cycling simulation device, said device comprising a support frame, with which a user carries out training by acting on the pedals of said bicycle, a flywheel rotating around a main shaft, connected to said coupling members, and a braking device, acting on said flywheel, comprising: a control logic unit, capable of connecting in transmission and reception with a remote device, by which a user can set one or more training parameters, and a torque sensor for detecting and sending to said control logic unit a signal related to the torque acting on said main shaft during the rotation of said flywheel, and said control logic unit being configured so as to adjust the braking force exerted by said braking device on said flywheel as a function of training parameters and of signal related to the torque acting on said main shaft detected by torque sensor.

12 Claims, 9 Drawing Sheets

(51) Int. Cl.

| | |
|---|---|
| ***A63B 22/06*** | (2006.01) |
| ***A63B 24/00*** | (2006.01) |
| ***A63B 21/005*** | (2006.01) |
| ***A63B 23/04*** | (2006.01) |
| ***A63B 71/06*** | (2006.01) |

(52) U.S. Cl.
CPC ..... *A63B 21/0058* (2013.01); *A63B 21/225* (2013.01); *A63B 21/4034* (2015.10); *A63B 22/0605* (2013.01); *A63B 23/04* (2013.01); *A63B 71/0622* (2013.01); *A63B 21/00069* (2013.01); *A63B 2220/20* (2013.01); *A63B 2220/54* (2013.01); *A63B 2220/805* (2013.01); *A63B 2225/20* (2013.01)

(58) Field of Classification Search
CPC ..... A63B 21/0058; A63B 21/4034; A63B 21/0057; A63B 23/04; A63B 2220/805; A63B 2220/54; A63B 2220/20; A63B 2225/20; A63B 21/0006
See application file for complete search history.

(56) References Cited

U.S. PATENT DOCUMENTS

| | | | | |
|---|---|---|---|---|
| 7,585,258 | B2 * | 9/2009 | Watson | A63B 24/00 188/159 |
| 7,837,595 | B2 * | 11/2010 | Rice | A63B 71/0622 434/61 |
| 2006/0003872 | A1 | 1/2006 | Chiles et al. | |
| 2008/0103030 | A1 * | 5/2008 | Watson | A63B 24/00 482/61 |
| 2012/0238406 | A1 * | 9/2012 | Beard | A63B 21/0053 482/2 |
| 2013/0059698 | A1 * | 3/2013 | Barton | A63B 71/0622 482/63 |

* cited by examiner

CONTROL SYSTEM OF A CYCLING SIMULATION DEVICE

CROSS-REFERENCE TO RELATED APPLICATION

This application claims the benefit of priority to Italian Patent Application No. 102016000068770, filed Jul. 1, 2016. The disclosure of the prior application is hereby incorporated in its entirety by reference.

The present invention relates to an improved control system of a cycling simulation device.

More specifically, the invention concerns an improved control system of a cycling simulation device of the mentioned type, designed and realized in particular for setting up and controlling a training program by means of a remote device and for assessing the quality of the execution of the training program by the user himself.

In the following, the description will be directed to a control system of a cycling simulation device that allows a user to set up and to control the training program via a tablet or a smartphone, but it is clear that the same should not be considered limited to this specific use.

As it is well known, currently the cycling simulation devices, also known as cyclosimulators or cyclo-ergometers, allow a user to carry out stationary cycling workouts, typically in closed environments or in limited spaces, using their own racing, road or mountain bicycle type.

A cycling simulation device typically comprises a base support or a frame, comprising a main support member, a base, to which said main support member is fixed, and two arms hinged to said base and capable of assuming a closed position, in which they are substantially parallel to each other, and an open position, in which they are spaced with respect to said central support member, so as to support the device.

The main member supports on one side a pulley, which the sprocket set or cassette is coupled with, which is part of the transmission system of the device-bicycle set.

Said main member on the opposite side supports a flywheel connected, by means of suitable transmission members, with said pulley, and braking members acting on said flywheel.

For performing a workout, a user can mount his bicycle on said simulation device just by removing the rear wheel and engaging the chain with the sprocket set, choosing the sprocket corresponding to the transmission or gear ratio to which the user intends to perform the training.

As is known, under the same active crown on the front wheel, the smaller sprockets determine a "long" transmission ratio, which is set by the user for high distances typically in the plain, while larger sprockets determine a "short" transmission ratio that is set by the user to perform high speed pedals to travel short distances.

In this way, by pedaling on the pedals of his bicycle, the user moves the flywheel, which simulates the pedaling resistance of a wheel and performs cycling workout. By means of the braking members, it is possible to adjust the effort to be performed and therefore the intensity of the training.

Usually, the user can manually adjust the opposite resistance from the pedal simulation device using cables acting directly on the brake, which acts on the flywheel.

As it is apparent, the use of the cables makes the user's workout uncomfortable because, in addition to holding the handlebar, the user has to hold the brake adjustment cables.

Simulation devices are also known, where the resistance control, and therefore the control of the brake acting on the flywheel, is remotely carried out.

In known simulation devices, generally the remote brake actuation is delayed with respect to the user-training program.

Furthermore, in the known simulation devices it is not possible for the user to have an indication of the quality of the correctness of the workout he is doing, this meaning that it is not possible to check the quality of his workout, since there are no real-time training quality control systems.

Therefore, it often happens that the pedaling of a user is ineffective due to an user unbalance during the pedal caused by a different use of the two legs by the user, and then to a differentiated push on the right and left pedal, which the user is not unaware of.

The result of this differentiated push is an ineffective and sometimes harmful workout.

In the light of the above, it is object of the present invention to provide an improved control system of a simulation device, which enables effective and instantaneous control of the force generated by the brake acting on the flywheel using simple and economical means.

Another object of the invention is to provide an improved control system that allows the user to check the quality of his workout in real time, so as to allow any corrections during pedaling.

It is therefore specific object of the present invention an improved control system of a cycling simulation device, said cycling simulation device being of the type comprising a support frame, on which coupling members are installed for coupling to the bicycle chain, with which a user carries out a training by acting on the respective pedals of said bicycle, a flywheel rotating around a main shaft, connected to said coupling members, and braking means, acting on said flywheel, comprising: a control logic unit, capable of connecting in transmission and reception with a remote device, by which a user can set one or more training parameters, and a torque sensor for detecting and sending to said control logic unit a signal related to the torque acting on said main shaft during the rotation of said flywheel, and said control logic unit being configured so as to adjust the braking force exerted by said braking means on said flywheel as a function of said training parameters set by said user and of said signal related to the torque acting on said main shaft detected by said torque sensor.

Always according to the invention, said system could comprise an optical sensor, coupled with said support frame, to detect values of the distance between at least one of the two pedals of said bicycle from the sensor itself and to send a corresponding signal to said control logic unit, for it to adjust the braking force exerted by said braking means on said flywheel as a function also of said signal.

Still according to the invention, said control logic unit could carry out a correlation between said signal received from said torque sensor and said signal received from said optical sensor, so as to associate a value of the torque acting on said main shaft to the position of said at least one bicycle pedal.

Always according to the invention said support frame could comprise a central elongated arm provided with two opposite ends, to which the ends of a first, a second and a third arm are pivotally coupled, said central arm being centrally positioned between said first and second arm, an optical sensor being positioned on said third arm, on the portion that faces towards said second arm for detecting the passage of the left pedal, corresponding to the left foot of the user, of said bicycle, with respect to the optical sensor itself; and/or an optical sensor being positioned on the portion that faces towards said second arm for detecting the passage of the right pedal, corresponding to the right foot of the user, of said bicycle, with respect to the optical sensor itself.

Further according to the invention, said remote device could show a preset graphical representation of the correlation carried out by said logic control unit of said signal received from said torque sensor and said signal received from said optical sensor.

It is further object of the present invention a cycling simulation device of the type comprising a support frame, on which coupling members are installed for coupling to the bicycle chain, with which a user carries out a training by acting on the respective pedals of said bicycle, a flywheel rotating around a main shaft, connected to said coupling members, braking means acting on said flywheel and a control logic unit, characterized in that said cycling simulation device comprises a torque sensor for detecting and sending to said control logic unit a signal as a function of the torque acting on said main shaft during the rotation of said flywheel, wherein said control logic unit is configured so as to receive a plurality of training parameters selected by said user from a remote device, and to adjust the braking force exerted by said braking means on said flywheel, as a function of said parameters set by said user and of said signal related to the torque acting on said main shaft detected by said torque sensor.

Always according to the invention, said device could comprise an optical sensor coupled with said support frame, to detect the values of the distance between at least one of the two pedals of said bicycle from the sensor itself and to send a signal proportional to said distance values to said control logic unit, for it to adjust the braking force exerted by said braking means on said flywheel as a function also of said signal.

Still according to the invention, said control logic unit could carry out a correlation between said signal received from said torque sensor and said signal received from said optical sensor, to associate a value of the torque acting on said main shaft to said at least one bicycle pedal.

Further according to the invention, said support frame could be of the type comprising a central elongated arm provided with two opposite ends, to which the ends of a first and a second and a third arm are pivotally coupled, said central arm being centrally positioned between said first and second arm, said optical sensor being positioned on said third arm in the portion that faces towards said second arm for detecting the passage of the left pedal of said bicycle.

Advantageously according to the invention, said support frame could be of the type comprising a central elongated arm provided with two opposite ends, to which the ends of a first and a second and a third arm are pivotally coupled, said central arm being centrally positioned between said first and second arm, said optical sensor being positioned on said third arm on the portion that faces towards said second arm for detecting the passage of the right pedal of said bicycle.

Still according to the invention, said braking means could comprise at least one permanent magnet, a magnet holder bracket housing said at least one permanent magnet, said magnet holder bracket being capable of assuming an inactive position, in which said at least one permanent magnet does not overlap over said flywheel, and an active position, in which said at least one permanent magnet is at least partially overlapped over said flywheel, and a motor, connected to, and controlled by said control logic unit, said motor being arranged for causing said magnet holder bracket to pass from said inactive position to an active position and vice-versa.

Always according to the invention, said magnet holder bracket could be pivoted about a pivot, and said braking means could comprise a worm screw, arranged to be rotated by said motor, and a nut screw, engaged with said worm screw, said nut screw being integral with, or fixed to said magnet holder bracket, so that when the control logic unit actuates said motor, said motor causes the rotation of said worm screw according to a first rotation direction, so as the nut screw to rotate and the magnet holder bracket to rotate about said pivot, so as to increasing the overlapping surface of said at least one permanent magnet, and when said motor rotates said worm screw in a second direction, opposite to said first rotation direction, said nut screw rotates said magnet holder bracket from said active position to said inactive position.

Always according to the invention, said braking means could comprise a first pair of permanent magnets and a second pair of permanent magnets, said first and said second pair of permanent magnets being housed within said magnet holder bracket, so that each permanent magnet of said first pair of permanent magnets is faced to one respective permanent magnet of said second pair of permanent magnets, said flywheel passing between said first and said second pair of permanent magnets.

Still according to a further embodiment of the invention, said braking means could be of electromagnetic type comprising a coil and a clutch, actuated by said coil made of winding turns, where the adjustment of the braking action is achieved by adjusting the current flowing through said winding turns.

It is also object of the present invention a method to control a device as described above, comprising the following steps of: a. providing a remote device, equipped with a memory unit, configured for setting one or more parameters relating to a plurality of trainings, stored in said memory unit, selectable by a user; b. operatively connecting said remote device to said control logic unit; c. selecting one predefined training program stored said the memory unit of said remote device, corresponding to a real predetermined path, which is identified with a plurality of fixed or manually adjustable parameters by the user, or based on parameters set by said user; d. sending said parameters relating to said selected predefined training program to said control logic unit; and e. adjusting the braking force exerted by said braking means on said flywheel as a function of said parameters relating to said selected predefined training program and of the signal related to the torque acting on said main shaft detected by said torque sensor.

Still according to the invention, said step e. comprises the following sub-steps: adjusting the braking force exerted by said braking means on said flywheel as a function also of said signal proportional to said values of the distance of at least of the two pedals from the sensor itself.

The present invention will be now described, for illustrative but not limitative purposes, according to its preferred embodiments, with particular reference to the figures of the enclosed drawings, wherein.

In the various figures, similar parts will be indicated by the same reference numbers.

Figure 1:
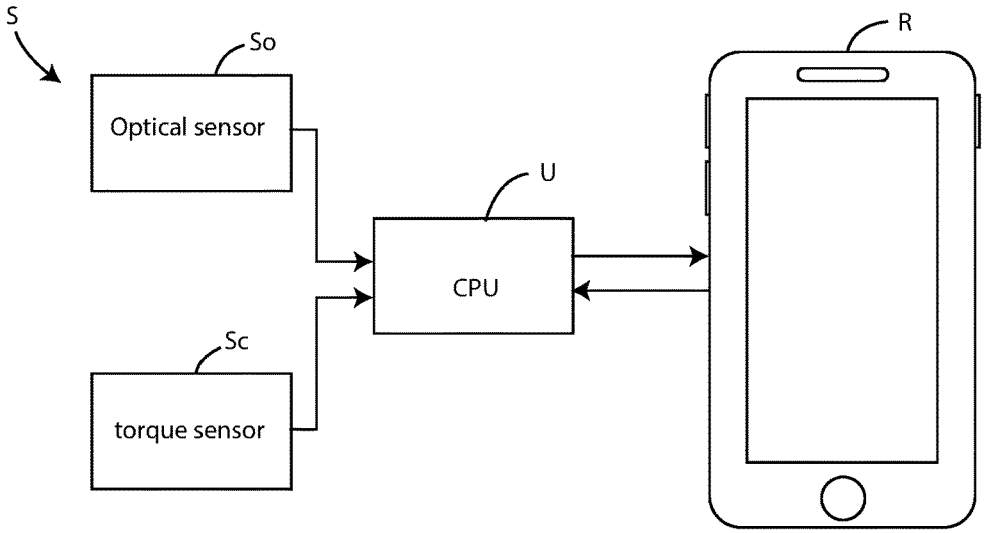
FIG. 1 shows a block diagram of the improved control system of a cycling simulation device object of the present invention.
Figure 2:
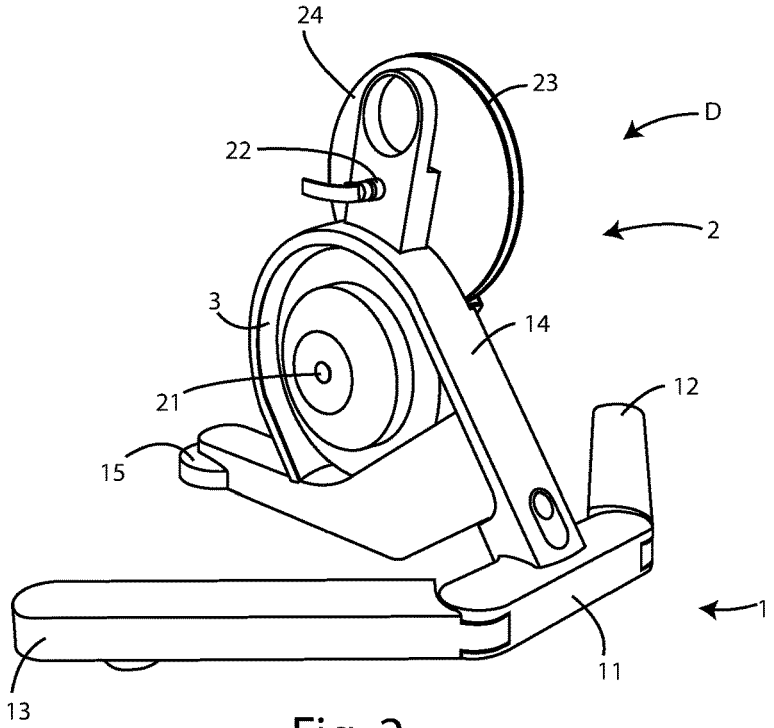
FIG. 2 shows a side perspective view of the cycling simulation device.

Referring to FIG. 1, the improved control system of a cycling simulation device S object of the present invention is observed, which includes a torque sensor or torque-meter $S_c$, an optical sensor $S_o$, a control logic unit U and a flywheel 3, on which braking means 40, comprising a permanent magnets brake supported by a magnet holder bracket driven by a motor, installed on said cycling simulation device, as better described below, and a remote control device such as a smartphone or a tablet R that interfaces with said control logic unit U.

Referring to FIGS. 2-8, a cycling simulation device D is shown, which includes a support frame 1, for the ground support of said device D, coupling members 2, for coupling said device D with a racing bicycle, road or mountain bike type, and said flywheel 3 covered by a cover casing.

Said frame 1 comprises a central elongated arm 11 having two opposed ends, to which the ends of two lateral arms, in particular a first 12 and a second 13 arm, are rotatably coupled, which can assume a closure position, in which they are substantially arranged parallel, and an opening position, in which they are spaced or spaced from said central arm 11, so as to support the cycling simulation device 1.

Said frame 1 comprises a main element 14 integral with said central arm 11, which is vertical with respect to said central arm 11.

Said main element 14 is supported by a third arm 15, centrally positioned between said first 12 and second 13 arm.

Said coupling members 2, supported by said frame 1, comprise a lower main shaft 21 and a secondary upper shaft 22 connected together with a belt 23, which is supported by a pulley 24.

Said pulley 24 is integral with said secondary shaft 22 and simulates the rear wheel of a bicycle to be coupled.

Figure 3:
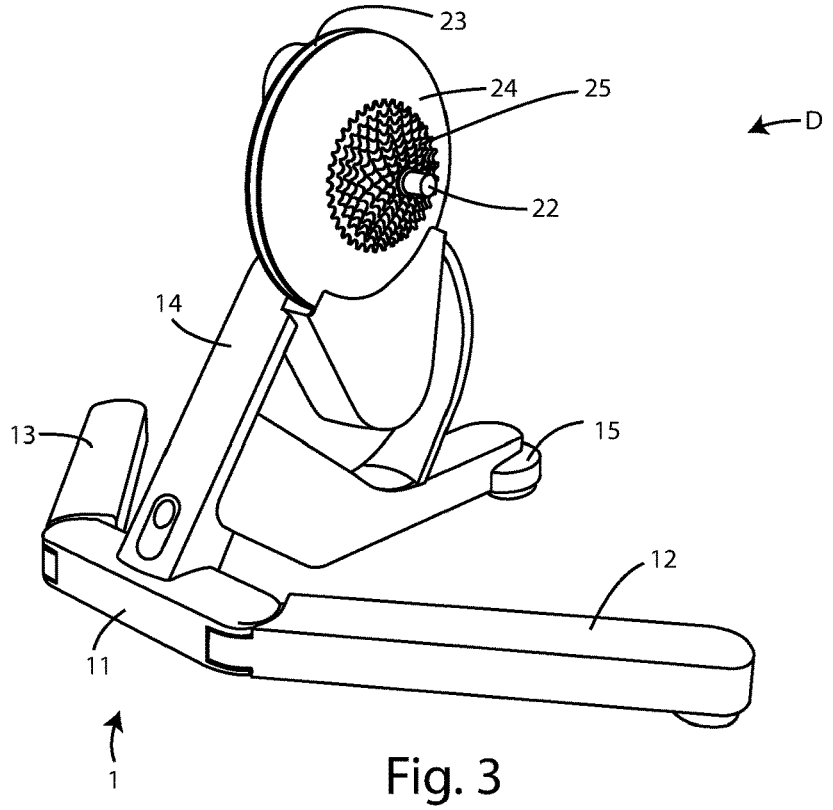
FIG. 3 shows a further side perspective view of the cycling simulation device.

Referring particularly to FIG. 3, said device D comprises a sprocket 25 or cassette pack, which the chain of said bicycle is engaged with, rotatably coupled with said secondary shaft 22 by means of a free wheel so as to remain integral with said secondary shaft 22, when the user pedals in the driving direction and capable of decoupling from said secondary shaft 22 when the user pedals in the opposite direction.

Said device D comprises said flywheel 3, which is rotatably coupled with said main element 14 by means of said main shaft 21, which will be described in detail hereinafter.

Figure 4:
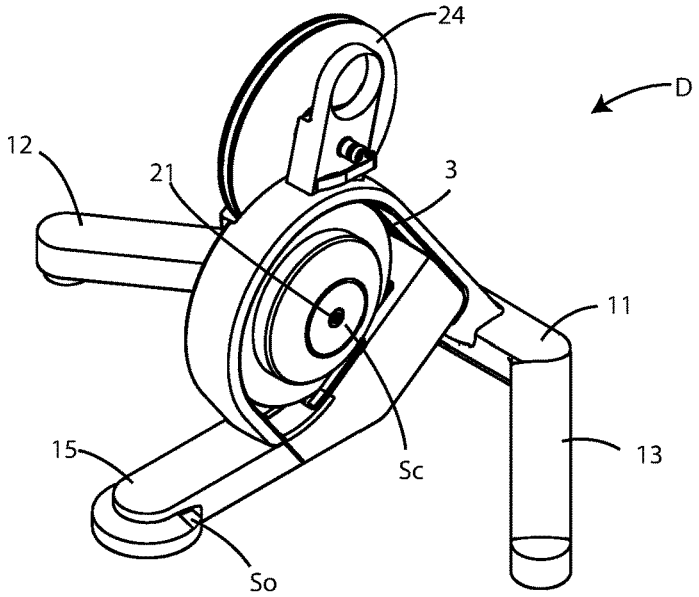
FIG. 4 shows a side perspective schematic view of the improved cycling simulation device.
Figure 5:
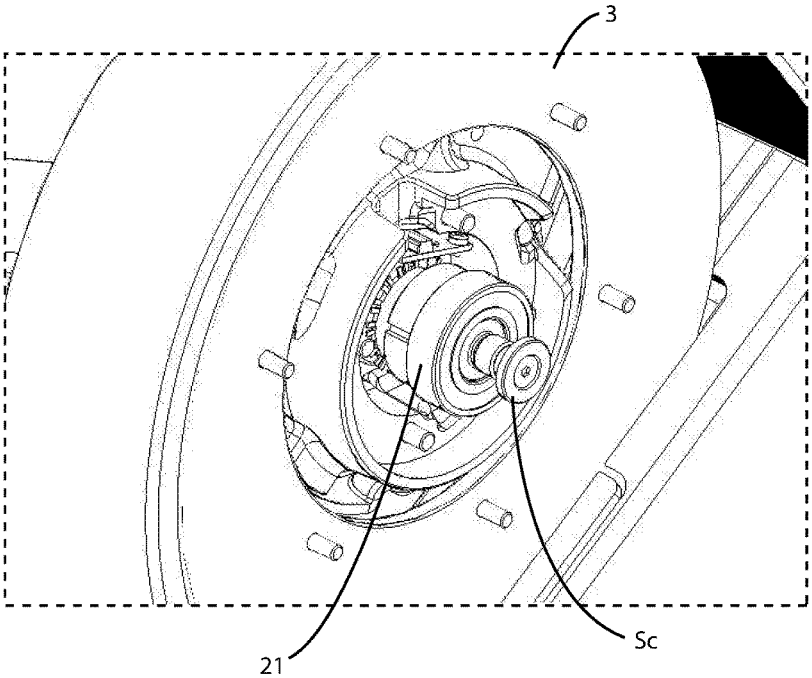
FIG. 5 shows a side view of a detail of FIG. 4.

Referring in particular to the FIGS. 4 and 5, as described above, said S system includes a torque sensor $S_c$ installed in said device D.

In particular, said torque sensor $S_c$ is installed on said main shaft 21 to carry out a measurement of the torque that acts on said shaft 21 during the pedaling, a measure of the rotation speed of said shaft 21, and therefore of said flywheel 3, and a measure of the pedaling rate, as it will be described in detail in the following.

Figure 7A:
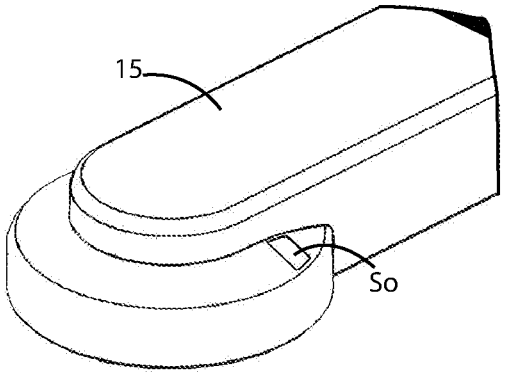
FIG. 7A shows a view of a detail of FIG. 4 with a cover.
Figure 7B:
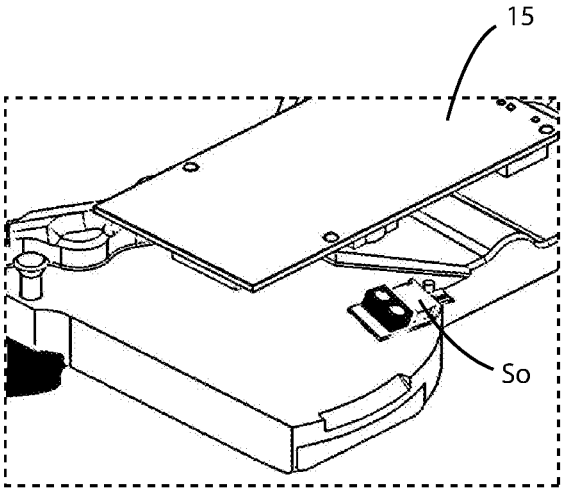
FIG. 7B shows a detail view of FIG. 7A without a cover.

Referring now in particular to FIGS. 7A and 7B, said system S also includes an optical sensor $S_o$ installed on said device D, in particular on said third arm 15 in the part that faces towards said second arm 13, in order to detect the passage of the crank arm of the left pedal of the bicycle, and then of the left foot of the user, and send to said control logic unit U a signal about the cadence of the left foot pedal over time.

In an alternative configuration it is possible to employ other types of sensor $S_o$ to make the detection of the distance, such as a laser sensor.

In an alternative embodiment, said optical sensor $S_o$ can be housed on said third arm 15 in the part that faces towards said first arm 12, in order to detect the passage of the crank arm of the right bicycle pedal and therefore of the right foot of the user.

Figure 8:
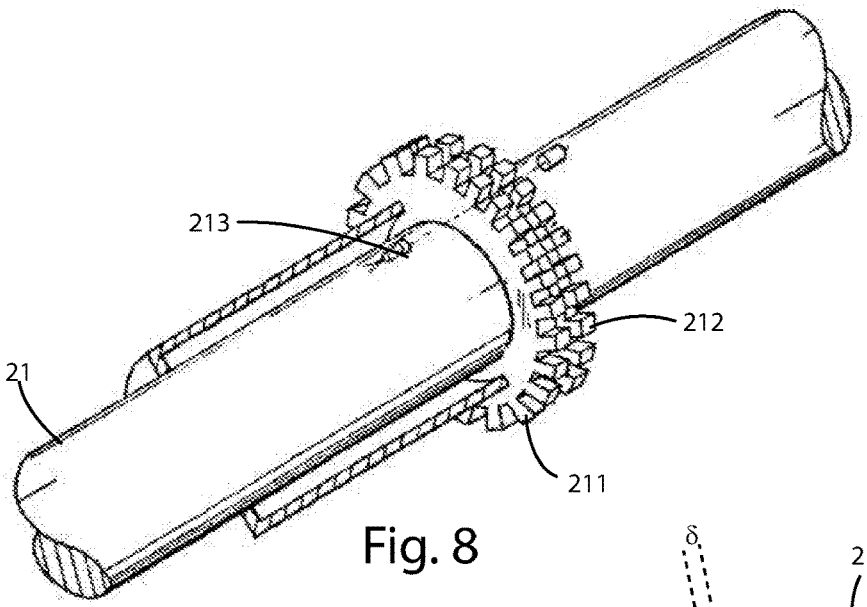
FIG. 8 shows a schematic side perspective view of a component of the simulation device.
Figure 9:
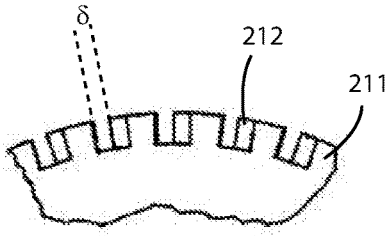
FIG. 9 shows a detail of FIG. 8.

Referring now to FIGS. 8 and 9, said main shaft 21 comprises a first 211 and a second 212 circular bushing adjacent to each other and integral with said shaft 21.

Said first 211 and second 212 bushing are provided on the circumference of respectively a first 211*a*, 211*b*, . . . , 211*n*, and a second plurality of equally spaced teeth 211*a*, 211*b*, . . . , 211*n*.

Initially said first 211*a*, 211*b*, . . . , 211*n*, and second plurality of teeth 211*a*, 211*b*, 211*n* are overlapped on one another. During the rotation of said shaft 21, these may undergo a phase shift due to the mechanical twisting to which said shaft 21 is subjected to during the use of said device D due to the torque exerted on said shaft 21 during pedaling by the shaft user.

Said torque sensor $S_c$ detects the phase shift between each tooth of said first plurality of teeth 211*a*, 211*b*, . . . , 211*n* and the corresponding tooth of said second plurality of teeth 211*a*, 211*b*, . . . , 211*n* and provides said control logic unit U the values of the torque during the time, as it will be described in detail below.

Said system S comprises a remote device R as a smartphone or a tablet, provided with an application and a wireless interface, in particular a Bluetooth type interface, for the connection with said control logic unit U for controlling said flywheel 3, and in particular the motor that actuates the magnet holder bracket supporting the permanent magnet brake acting on the flywheel 3, according to the user-selected training program.

Figure 6A:
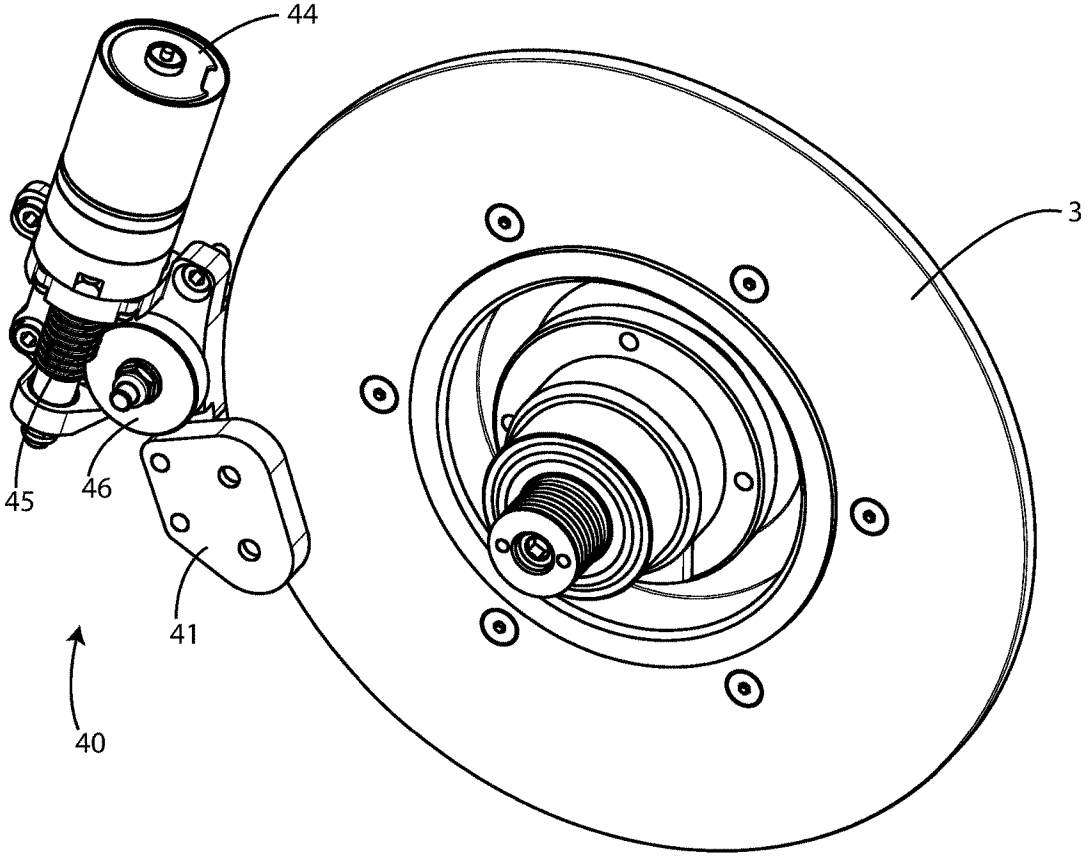
FIG. 6A shows a permanent magnet brake of the cycling simulation device according to the present invention.
Figure 6B:
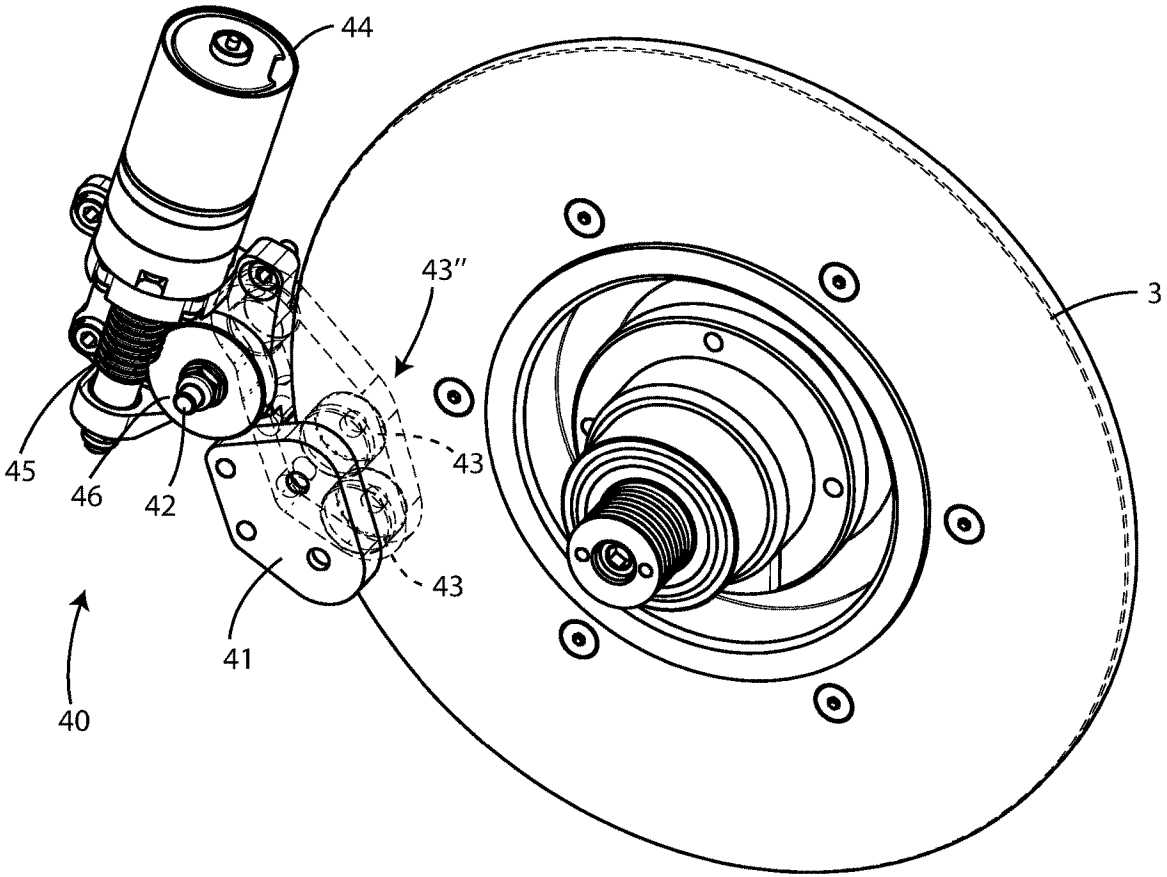
FIG. 6B shows a partially transparent view of the permanent magnet brake of FIG. 6A.
Figure 6C:
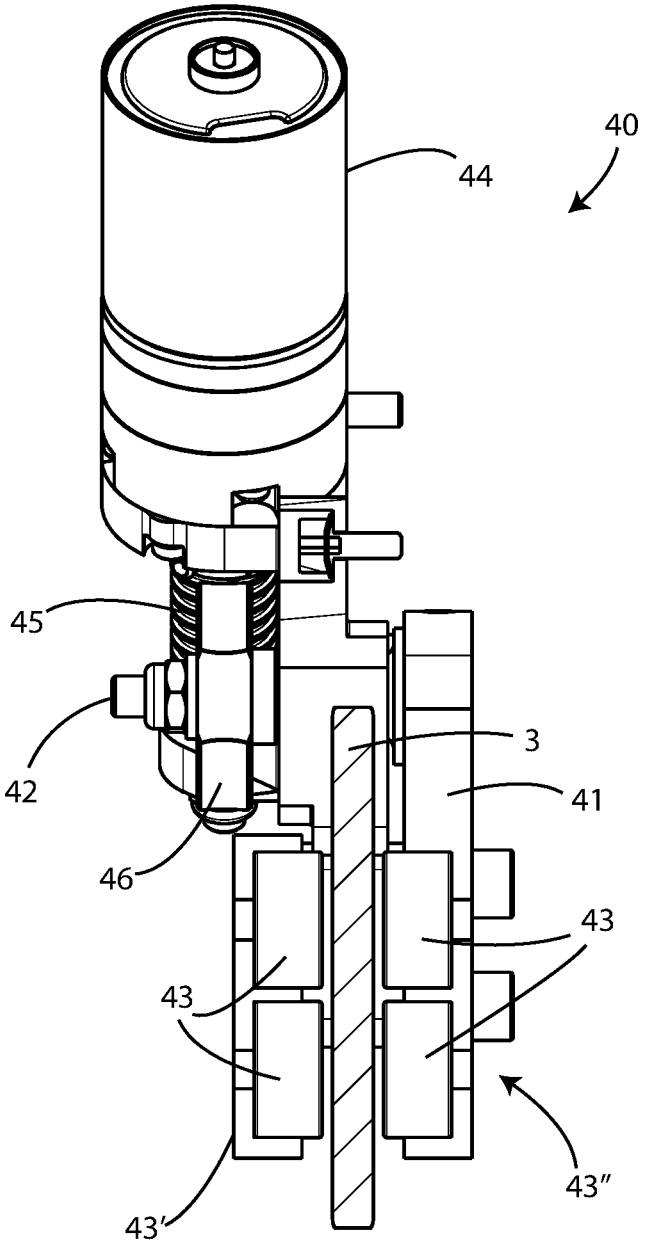
FIG. 6C shows a section view of a part of the permanent magnet brake of FIG. 6A.

In particular, FIGS. 6A-6C show the abovementioned braking means 40, which, in the embodiment shown, comprise a magnet holder bracket 41, pivoted about a pivot 42, and first 43' and a second 43" pair of permanent magnets 43, housed within said magnet holder bracket 41, so that each permanent magnet 43 of said first pair of permanent magnets 43' is faced to a respective permanent magnet 43 of said second pair of permanent magnets 43", in such a way that the flywheel 3 can pass between the magnets 43 of said first 43' and said second 43" pairs of permanent magnets.

Said magnet holder bracket 41 can assume an inactive position, in which the permanent magnets 43 of said first 43' and said second 43" pairs of permanent magnets are not overlapped over the flywheel 3, and active positions, in which said permanent magnets 43 of said first 43' and said second 43" pairs of permanent magnets are at least partially overlapped over the flywheel 3.

Said braking means 40 also comprise a motor 44, preferably an electric motor 44, arranged for rotating a worm screw 45, and a nut screw 46, engaged with said worm screw 45. Said nut screw 46 being integral with, or fixed to said magnet holder bracket 41, in order to cause, when rotated, said magnet holder bracket 41 to pass from said inactive position to said active position.

When the control logic unit U actuates the motor 44, the latter causes the rotation of the worm screw 45 according to a first rotation direction, so as to rotate the nut screw 46.

Therefore, the magnet holder bracket 41 rotates about the pivot 42, causing the increase of the overlapping surface of the permanent magnets 43 of said first 43' and said second 43" pairs of permanent magnets over the flywheel 3. This increases the braking action on the (rotating) flywheel 3, due to the eddy currents induced therein. The flywheel 3 is made of an appropriate metal material.

When said motor 44 rotates in the worm screw 45 in a second direction, opposite to said first rotation direction, said nut screw 46 rotates said magnet holder bracket 41 from said active position to said inactive position. Alternatively, the brake can be of electromagnetic type and in that case the adjustment is by adjusting the current flowing through the winding turns.

By training it is referred to the execution by a user of a pedal following a particular path stored in the memory of said remote device R based on predetermined paths, such as a known race path, so as to simulate a real street pedaling.

Figure 12:
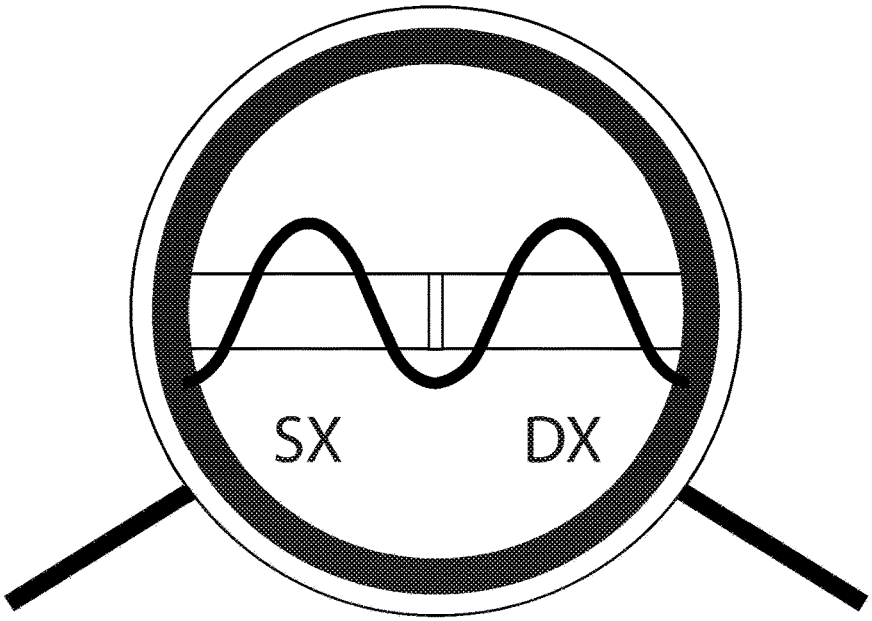
FIG. 12 shows a graphical view of a visualization form of the response of the execution of the training program by the improved cycling simulation device.
Figure 13:
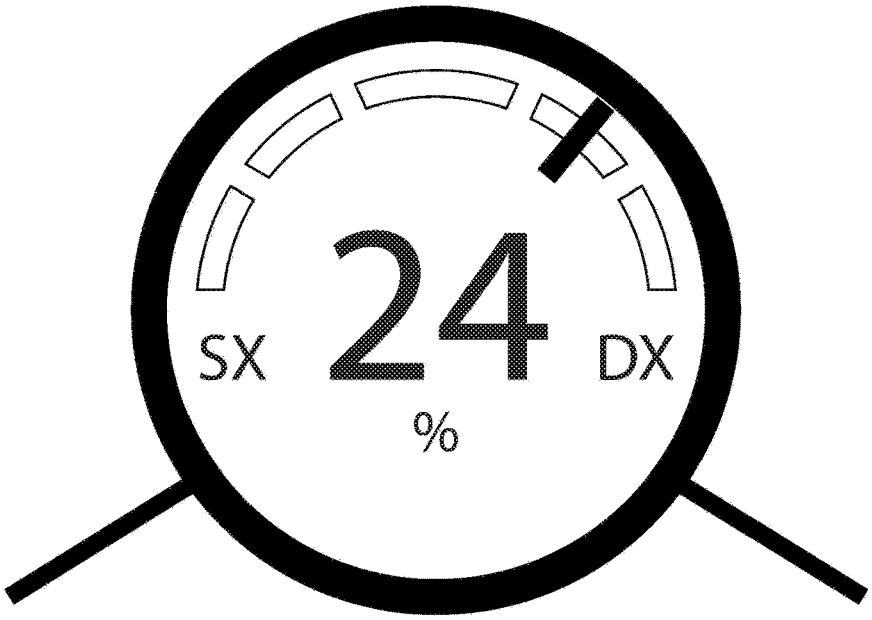
FIG. 13 is a graphical view of a further visualization form of the response of the training program by the improved cycling simulation device.

Said remote device R allows the user to set the training he or she intends to perform on said device D and graphically display a representative training quality curve he or she is performing as shown in FIG. 12, or a movable bar can be displayed on a series of colored squares, as shown in FIG. 13.

The operation of the system S described above is as follows.

Preliminarily, when a user intends to perform a workout in an indoor space where said cycling simulation device D is available, directly on his bicycle, disassembles the rear wheel and mounts the chain on a pinion of said sprocket 25 of said device D.

Then He activates the application of his remote device R and sets up a workout.

The types of training are mainly two: a constant power training and a constant slope training.

In the constant power training, the user sets a fixed power value P expressed in Watts in the training program included in the application of his remote device R.

The user can also make manual adjustments to said predetermined paths, for example by setting a fixed power value.

In the slope training, the user can select one out of a plurality of workouts stored in the memory of said remote device R, based on predetermined paths, such as a known race path, so as to simulate a real road pedal.

Also in this case, the user can make manual changes to the preset path, for example, by changing the slope.

As regards the power training, the power P is given by the product between torque, or the brake resistance on said flywheel 3, and the rotational speed of said main shaft 21.

Depending on the user's pedaling speed, said control logic unit U adjusts the braking force acting on said flywheel 3.

In particular, during the rotation of said main shaft 21, said torque sensor $S_c$ detects, according to a known way, the phase shift between each tooth of said first plurality of teeth 211*a*, 211*b*, . . . , 211*n* and the corresponding tooth of said second plurality of teeth 211*a*, 211*b*, . . . , 211*n*, detecting the beam emitted by an infrared source 213 and passing through free space δ, as shown in FIG. 9.

Said space δ is the free space between two contiguous teeth of the first plurality of teeth 211*a*, 211*b*, . . . , 211*n*, which does not overlap with a tooth of the second plurality of teeth 211*a*, 211*b*, . . . , 211*n*.

In particular, said torque sensor $S_c$ detects the amount of light passing through said space δ, alternatively, it can detect the time that elapses between the passage of one space δ and the passage of immediately following space δ+1.

Figure 10:
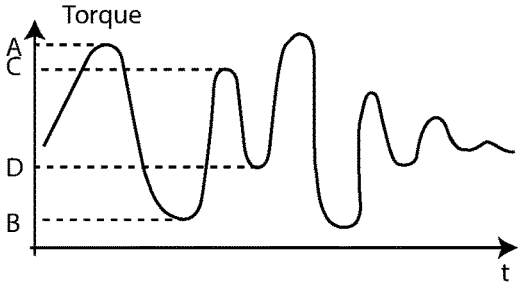
FIG. 10 shows the trend of a signal used in the operation of the system in a Cartesian plane.

Said torque sensor sends these data to said control logic unit U, which generates a trend over the time of the torque acting on said main shaft 21, obtaining a substantially sinusoidal signal as shown in FIG. 10.

From these data the torque measurement acting on said main shaft 21, the rotation speed of said flywheel 21 and the pedaling rate derived from the maximum and minimum values A, B, C, D of the signal, as shown in FIG. 10, can be obtained.

Said optical sensor $S_o$ instead detects the distance of the arm crank of the left pedal and sends to said control logic unit U a time pulse each time the crank arm, and then the user's foot, passes close to said optical sensor $S_o$.

Figure 11:
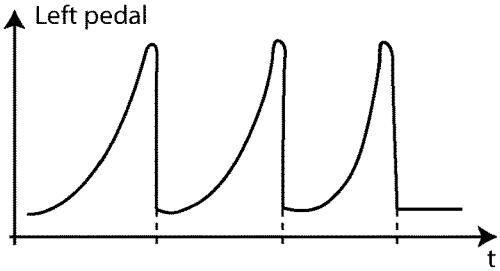
FIG. 11 shows the trend of a further signal used in the operation of the system in a Cartesian plane.

Said control logic unit U processes these pulses and generates a pulse-time trend, obtaining a substantially triangular signal as shown in FIG. 11.

In particular, the trend of FIG. 11 shows a sequence of curves having a first rising section due to the detection of said optical sensor $S_o$ in the approaching of the left foot of the user and a part that decreases immediately to zero, due to the passage of the foot over said optical sensor $S_o$.

The control logic unit U performs a correlation between the sinusoidal curve and the triangular curve.

Specifically, after detecting the first pulse corresponding to the passage of the left foot, the logic control unit U associates the next torque peak to the right foot.

By means of these two signals, said logic control unit can cyclically solve the known Ambrosini equation that describes the motion of the bike in terms of the power delivered on the pedals as a function of parameters such as the weight of the user and of the bike, the road slope, the asphalt friction coefficient, the aerodynamic coefficient, the speed of the bike and the gravity acceleration.

Said parameters are already stored in the application contained in said remote device R, while the user's weight value is set by the user at the moment the workout begins.

During the power training, having this to remain constant, according to the user's pedaling rate, said control logic unit U calculates the expected torque value on the rear wheel and then on said pulley 23, thereby activating the permanent magnets brake motor acting on said flywheel 3. If the pedaling speed is high, so that the torque and speed product remains constant, said control logic unit U increases the torque and then the resistance opposed by said flywheel 3 to the pedal, the opposite occurs in case of the pedaling speed is low.

As to the slope training, as described above, the user can select a workout based on a predetermined path on his remote device R, such as a known race path.

Depending on the type of selected path and on the transmission ratio selected by the user, the control logic unit U determines the torque that has to act on said flywheel 3, based on the solution of the motion equation described above.

For example, if in the path set by the user on his remote device R a low-slope section is provided with, such as a descend, said remote device R sends information to said system S, which consequently has to reduce the resistance value on said flywheel 3, thus driving remotely the motor that moves said permanent magnet brake, so as to move away from said flywheel 3, thus simulating a slope.

In this way, the user is forced to ride at a higher speed and then to choose a "longer" transmission ratio.

If, on the other hand, in the path set by the user on his remote device R there is a high slope section, said remote device R transmits the information to said system S, which has consequently to increase the resistance value on said flywheel 3, by remotely activating the motor that moves said permanent magnet brake, so as it to approach said flywheel 3, thus simulating a rise.

In this way, the user is forced to ride at a lower speed and then to choose a "shorter" transmission ratio.

During the training, said control logic unit U performs a continuous correlation over time between the sine curve and the triangular curve and sends to said remote device R the value of the torque peak generated during a pedal by the right foot, the minimum value of the torque generated during a pedal by the right foot, the torque peak value generated during a left foot pedal, the minimum value generated during a foot pedal from the left foot and the time intervals between the values A and B, B and C, C and D, and the following value A of the next pedal.

By means of these data, said remote device R allows to display the graphical representations of FIG. 12 or 13.

Referring to FIG. 12, the first part of the curve relates to the pedal with the left foot, while the second part of the curve relates to the pedal with the right foot and are overlapped on a reference line shown on said remote device R in green color.

Specifically, if the user pedals at a very high speed by pushing a lot on the pedals and retracting them equally quickly, the area underneath the curve will be elevated as it increases the curve width with respect to the reference base.

As to the graph of FIG. 13, it represents a bar that moves along the colored rectangles and a numerical value expressed as a percentage.

If the user pedals in a balanced manner, the bar will be positioned substantially in the center of the rectangles, otherwise it will be unbalanced to the right or to the left of the rectangles if, respectively, he employs more strength with the right or left foot.

These views provide an feedback on the training quality to the user, who can correct his posture and the use of his limbs during the training.

As it can be seen from the above description, the improved control system allows for precise remote control of the resistance generated by a cycling simulation device using simple and economic tools.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. Improved control system of a cycling simulation device, said cycling simulation device being of the type comprising a support frame, on which coupling members are installed for coupling to a bicycle chain, with which a user carries out a training by acting on the respective left and right pedals of a bicycle, a flywheel rotating around a main shaft connected to said coupling members, and a braking device, acting on said flywheel, comprising:

a control logic unit, capable of connecting in transmission and reception with a remote device, by which a user can set one or more training parameters, a torque sensor for detecting and sending to said control logic unit a signal related to the torque acting on said main shaft during the rotation of said flywheel, an optical sensor, coupled with said support frame, to detect values of the distance between at least one of the two pedals of said bicycle from the optical sensor itself and to send a corresponding signal to said control logic unit, and said control logic unit being configured so as to adjust a braking force exerted by said braking device on said flywheel as a function of said training parameters set by said user and of said signal related to the torque acting on said main shaft detected by said torque sensor, wherein said control logic unit carries out a correlation between said signal received from said torque sensor and said signal received from said optical sensor, so as to associate a value of the torque acting on said main shaft to the position of said at least one bicycle pedal.

2. System according to claim 1, wherein said support frame comprises a central elongated arm provided with two opposite ends, to which ends of a first, a second and a third arm are pivotally coupled, said central elongated arm being centrally positioned between said first and second arm, the optical sensor being positioned on said third arm, on a portion that faces towards said second arm for detecting the passage of the left pedal, corresponding to the left foot of the user, of said bicycle, with respect to the optical sensor itself; and/or the optical sensor being positioned on said third arm on a portion that faces towards said second arm for detecting the passage of the right pedal, corresponding to the right foot of the user, of said bicycle, with respect to the optical sensor itself.

3. System according to claim 1, wherein said remote device shows a preset graphical representation of the correlation carried out by said logic control unit of said signal received from said torque sensor and said signal received from said optical sensor.

4. Cycling simulation device of the type comprising a support frame, on which coupling members are installed for coupling to a bicycle chain, with which a user carries out a training by acting on respective left and right pedals of a bicycle, a flywheel rotating around a main shaft connected to said coupling members, a braking device acting on said flywheel and a control logic unit, characterized in that said cycling simulation device comprises:

a torque sensor for detecting and sending to said control logic unit a signal as a function of the torque acting on said main shaft during the rotation of said flywheel, and an optical sensor coupled with said support frame, to detect the values of the distance between at least one of the two pedals of said bicycle from the optical sensor itself and to send a signal proportional to said distance values to said control logic unit, wherein said control logic unit is configured so as to receive a plurality of training parameters selected by said user from a remote device and to adjust a braking force exerted by said braking device on said flywheel, as a function of said parameters set by said user and of said signal related to the torque acting on said main shaft detected by said torque sensor, wherein said control logic unit carries out a correlation between said signal received from said torque sensor and said signal received from said optical sensor, to associate a value of the torque acting on said main shaft to said at least one bicycle pedal.

5. Device according to claim 4, wherein said support frame is of the type comprising a central elongated arm provided with two opposite ends, to which ends of a first arm, a second arm, and a third arm are pivotally coupled, said central elongated arm arm being centrally positioned between said first and second arm, said optical sensor being positioned on said third arm in a portion that faces towards said second arm for detecting the passage of the left pedal of said bicycle.

6. Device according to claim 4, wherein said support frame is of the type comprising a central elongated arm provided with two opposite ends, to which the ends of a first and a second and a third arm are pivotally coupled, said central arm being centrally positioned between said first and second arm, said optical sensor being positioned on said third arm on the portion that faces towards said second arm for detecting the passage of the right pedal of said bicycle.

7. Device according to claim 4, wherein said braking device comprises:

at least one permanent magnet, a magnet holder bracket housing said at least one permanent magnet, said magnet holder bracket being capable of assuming an inactive position, in which said at least one permanent magnet does not overlap over said flywheel, and an active position, in which said at least one permanent magnet is at least partially overlapped over said flywheel, and a motor, connected to, and controlled by said control logic unit, said motor being arranged for causing said magnet holder bracket to pass from said inactive position to an active position and vice-versa.

8. Device according to claim 7, wherein said magnet holder bracket is pivoted about a pivot, and said braking device comprises:

a worm screw, arranged to be rotated by said motor, and a nut screw, engaged with said worm screw, said nut screw being integral with, or fixed to said magnet holder bracket, so that when the control logic unit actuates said motor, said motor causes the rotation of said worm screw according to a first rotation direction, so as to rotate the nut screw and the magnet holder bracket to rotate about said pivot, so as to increase the overlapping surface of said at least one permanent magnet, and when said motor rotates said worm screw in a second direction, opposite to said first rotation direction, said nut screw rotates said magnet holder bracket from said active position to said inactive position.

9. Device according to claim 7, wherein said braking device comprises:

a first pair of permanent magnets, and a second pair of permanent magnets, said first and said second pair of permanent magnets being housed within said magnet holder bracket, so that each permanent magnet of said first pair of permanent magnets is faced to one respective permanent magnet of said second pair of permanent magnets, said flywheel passing between said first and said second pair of permanent magnets.

10. Device according to claim 4, wherein said braking device is of electromagnetic type comprising a coil and a clutch, actuated by said coil made of winding turns, where the adjustment of the braking action is achieved by adjusting a current flowing through said winding turns.

11. Method to control a device according to claim 4, comprising the following steps of:

a. providing a remote device, equipped with a memory unit, configured for setting one or more parameters relating to a plurality of trainings, stored in said memory unit, selectable by a user;

b. operatively connecting said remote device to said control logic unit;

c. selecting one predefined training program stored said the memory unit of said remote device, corresponding to a real predetermined path, which is identified with a plurality of fixed or manually adjustable parameters by the user, or based on parameters set by said user;

d. sending said parameters relating to said selected predefined training program to said control logic unit; and e. adjusting the braking force exerted by said braking device on said flywheel as a function of said parameters relating to said selected predefined training program and of the signal related to the torque acting on said main shaft detected by said torque sensor.

12. Method according to claim 11, wherein said step e. comprises the following sub-steps:

adjusting the braking force exerted by said braking device on said flywheel as a function also of said signal proportional to said values of the distance of at least one of the two pedals from the optical sensor itself.

* * * * *